US008517214B2

(12) United States Patent
Lowry et al.

(10) Patent No.: US 8,517,214 B2
(45) Date of Patent: Aug. 27, 2013

(54) GRAVITY-FED DISPENSER

(76) Inventors: Deborah J. Lowry, Tampa, FL (US); Roberta Royak, Tampa, FL (US); Paul Royak, Tampa, FL (US); Lawrence Hudson, Tampa, FL (US)

( * ) Notice: Subject to any disclaimer, the term of this patent is extended or adjusted under 35 U.S.C. 154(b) by 0 days.

(21) Appl. No.: 13/275,891

(22) Filed: Oct. 18, 2011

(65) Prior Publication Data

US 2012/0091163 A1 Apr. 19, 2012

Related U.S. Application Data

(60) Provisional application No. 61/394,656, filed on Oct. 19, 2010.

(51) Int. Cl.

| | |
|---|---|
| ***B65D 83/00*** | (2006.01) |
| ***G07F 9/10*** | (2006.01) |
| ***B65G 59/06*** | (2006.01) |
| ***B65H 1/30*** | (2006.01) |

(52) U.S. Cl.
USPC ..... 221/131; 221/124; 221/287; 221/150 R; 221/281

(58) Field of Classification Search
USPC ..... 221/150 R, 123, 124, 131, 197, 281, 221/287
See application file for complete search history.

(56) References Cited

U.S. PATENT DOCUMENTS

| | | | | |
|---|---|---|---|---|
| 3,929,256 | A * | 12/1975 | Solomon | 221/81 |
| 4,190,678 | A * | 2/1980 | Pleus | 426/478 |
| 4,676,074 | A * | 6/1987 | Morgan et al. | 62/277 |
| 4,718,578 | A * | 1/1988 | Radek et al. | 222/108 |
| 4,783,967 | A * | 11/1988 | Mullen | 62/3.3 |
| 4,955,529 | A * | 9/1990 | Barnhart | 229/122.1 |
| 5,199,348 | A * | 4/1993 | Cimenti | 99/510 |
| 5,247,798 | A * | 9/1993 | Collard, Jr. | 62/3.62 |
| 5,560,519 | A * | 10/1996 | Moore et al. | 222/129 |
| 5,826,746 | A * | 10/1998 | Ash, Jr. | 221/185 |
| 5,884,499 | A | 3/1999 | Samborn | |
| 6,173,582 | B1 * | 1/2001 | Hixson | 62/457.4 |
| 6,685,051 | B2 * | 2/2004 | Zangari et al. | 221/67 |
| 7,418,311 | B1 * | 8/2008 | Lagassey et al. | 700/236 |
| 7,810,350 | B2 * | 10/2010 | Shelton | 62/457.5 |
| 2008/0035664 | A1 * | 2/2008 | Berger | 221/97 |
| 2008/0277407 | A1 | 11/2008 | Leonetti | |
| 2010/0151083 | A1 | 6/2010 | Klier et al. | |

OTHER PUBLICATIONS

Hang, Chang Soo, Notification of Transmittal of the International Search Report and the Written Opinion of the International Searching Authority or the Declaration, May 22, 2012.

* cited by examiner

*Primary Examiner* — Michael K Collins
(74) *Attorney, Agent, or Firm* — Kegler Brown Hill & Ritter; James J. Pingor

(57) ABSTRACT

Systems and methods related to dispensing food (e.g., fruit) or other items in a "first-in, first-out" manner are discussed. The system can include a base having one or more cavities therein and a plurality of chutes configured to align within a subset of the cavities. Each of the chutes can include an inlet that can provide access to an open interior for storage of items, and the plurality of chutes can dispense the plurality of items in a "first-in first out" manner. An ice chest capable of cooling the plurality of chutes can be included, as can a drip tray or other mechanism for separating the fruit from its juices to prolong its useful lifespan.

20 Claims, 11 Drawing Sheets

GRAVITY-FED DISPENSER

CROSS-REFERENCE TO RELATED APPLICATIONS

This application claims the benefit of U.S. Provisional Patent application Ser. No. 61/394,656 entitled "GRAVITY FRUIT DISPENSER" and filed Oct. 19, 2010. The entirety of the above-noted application is incorporated by reference herein.

BACKGROUND

Many bars and restaurants are equipped with conventional fruit trays, for example, to hold cocktail garnishes (e.g., cherries, limes, lemons, pineapples). Unfortunately, these traditional tray systems result in a large amount of food spoilage that translates into cost, expense and lower profits for businesses, as well as creates an unsanitary breeding ground for germs. In accordance with these conventional systems, as a matter of course, bartenders simply place new fruit on top of the older fruit. Because traditional fruit trays employ a "first-in last-out" dispensing mechanism, the older fruit is prone to rot by sitting in its own juice. Unfortunately, in many instances, this rotten fruit is either used as garnishes or, more often, discarded. Thus, there is a need in the industry to provide a more efficient and effective mechanism by which fruit can be distributed, thereby reducing costs associated with waste and spoilage, and creating a more sanitary environment.

SUMMARY

The following presents a simplified summary of the innovation in order to provide a basic understanding of some aspects of the innovation. This summary is not an extensive overview of the innovation. It is not intended to identify key/critical elements of the innovation or to delineate the scope of the innovation. Its sole purpose is to present some concepts of the innovation in a simplified form as a prelude to the more detailed description that is presented later.

In aspects, the innovation can include a dispensing system. The system can include a base that can have one or more cavities in it. The system can also have a plurality of chutes configured to align within a subset of the cavities. Each of the chutes can include an inlet that provides access to an open interior that facilitates storage of items. Additionally, the plurality of chutes can be capable of dispensing the plurality of items in a "first-in first out" manner. The system can further include an ice chest capable of cooling the plurality of chutes.

In other aspects, the innovation can include a method of dispensing items. The method can include the acts of placing a plurality of items into one or more chutes via an inlet of each chute and storing the plurality of items in the plurality of chutes. Additionally, the method can also include the steps of cooling the plurality of items stored in the plurality of chutes via an ice chest and dispensing the plurality of items in a "first-in, first-out" manner.

To the accomplishment of the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1:
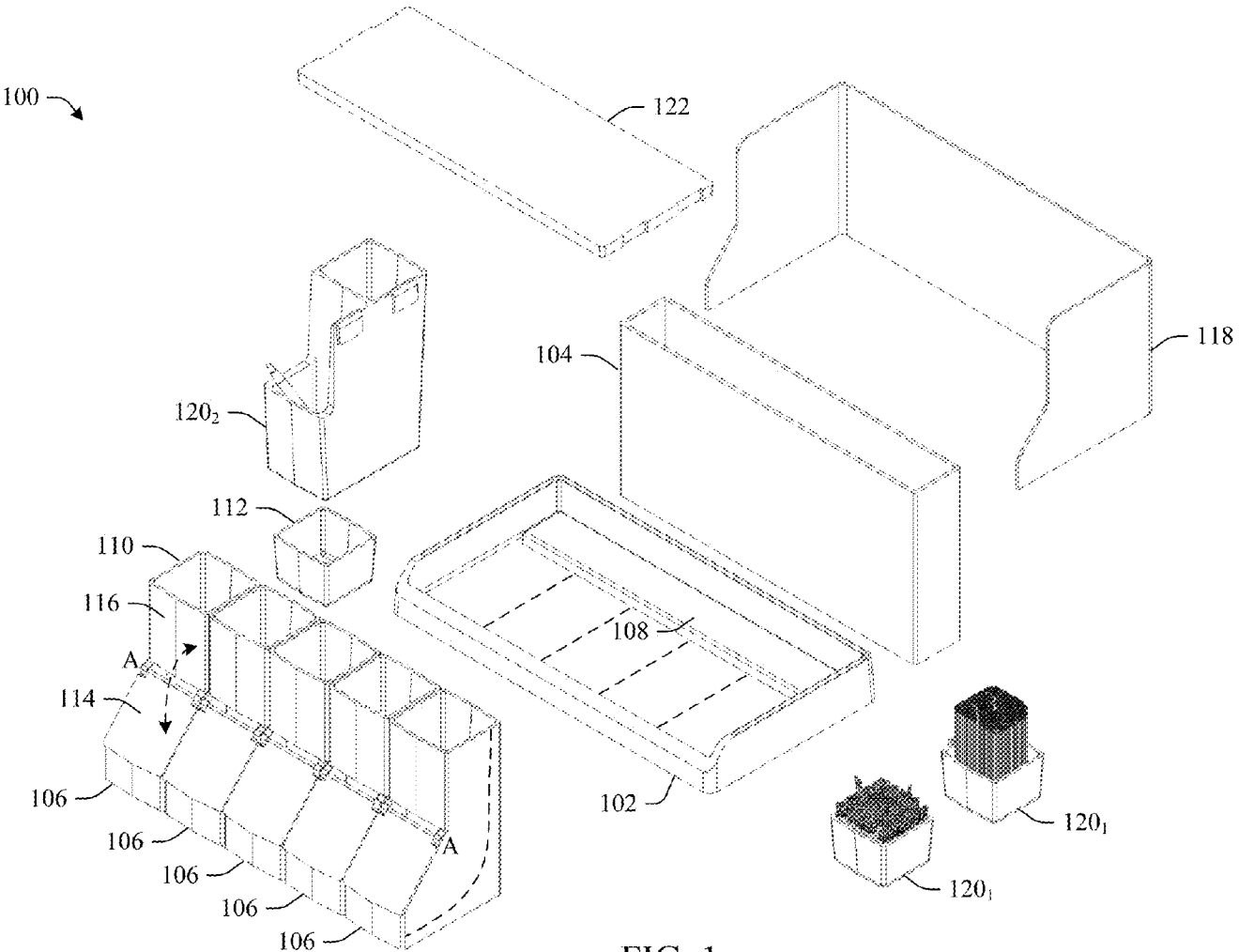
FIG. 1 illustrates a perspective view of an example dispenser in accordance with aspects of the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details. In other instances, well-known structures and devices are shown in block diagram form in order to facilitate describing the innovation.

The innovation disclosed and claimed herein, in one aspect thereof, comprises a gravity-fed dispenser of items (as used herein, the term items is intended to encompass any of a variety of items dispensable via a dispenser such as that discussed herein, including, e.g., fruit, vegetables, other garnishes, or other edible or non-edible items, etc.) that is capable of addressing some of the aforementioned drawbacks of conventional fruit tray designs. The innovation can include a housing or base configured to retain a plurality of storage chutes, containers, or sleeves. These chutes can be specially designed for the type of fruit (or foodstuff). For instance, some chutes can be designed with drain holes while others can be designed to retain fluids (e.g., juices, brine, etc.).

In another aspect of the subject innovation, a cooling mechanism such as an ice chest or ice tray can be provided. A coolant (e.g., ice, etc.) can be inserted into or otherwise attached to the base (e.g., via an ice chest) to chill or maintain a desired temperature. A drip pan(s) can be provided so as to discard or remove any unwanted juices (or other liquids). Similarly, a drain mechanism can be provided to enable drainage of melted ice or water. In yet other aspects, a powered cooling mechanism (e.g., electrical, condenser, etc.) can be provided so as to enhance temperature control. Still further, it is to be understood that the chutes can be modular in design such that, if desired, a user can employ most any number or type of chutes in an arrangement. Additionally, in aspects, the innovation need not have a base, but rather, the chutes can be configured so as self-attach and to provide rigidity and integrity to the apparatus.

Referring initially to the drawings, FIG. 1 illustrates an example gravity-fed dispenser 100 in accordance with aspects of the subject innovation. In various embodiments, dispenser 100 can comprise a base 102, an ice chest 104, and one or more chutes 106, and can be used for dispensing food such as fruit, vegetables, or other garnishes, as well as other items. Additionally, in some aspects, dispenser 100 can include additional or alternative components described further herein. It is to be understood that although multiple components are depicted in FIG. 1, not all components are necessary in accordance with various embodiments of the subject innovation.

Optionally, base 102 can include one or more cavities or recessed portions capable of holding or securing ice chest 104 and the one or more chutes 106, such as by including an optional ice chest cavity, slot, or platform 108, or the optional raised edge around base 102 that can define a region for the one or more chutes 106. In some examples, ice chest 104 and the one or more chutes 106 can be arranged in a common cavity, or in two or more distinct cavities (optionally, with one or more raised or recessed portions, dividers, etc. to facilitate alignment). As another example, in some embodiments, means can be included to align the one or more chutes 106, such as by the inclusion of raised dividers defining one or more slots for the one or more chutes 106 (for example, as indicated by the dashed lines in base 102, etc.), one or more raised or recessed portions of base 102 that can couple to one or more recessed or raised portions, respectively, on the one or more chutes 106, or other similar features as would be understood by a person of skill in the art in light of the teachings herein. Depending on the relative dimensions of base 102 and the one or more chutes 106, different numbers of chutes 106 can be housed in base 102. For example, five chutes 106 are shown in FIG. 1, although it is to be understood that this embodiment is a non-limiting example, and substantially any number of chutes can be housed in varying embodiments.

Additionally, in some aspects, base 102 can comprise a drainage portion or one or more drip trays (e.g., one for each chute 106 that could fit into base 102, etc.) located under where the one or more chutes 106 can be positioned, and can collect fluids such as juices, brine, etc. In one embodiment, a drip tray or drainage portion can be incorporated into a chute 106, and can be drained by removal of a cap that can form an air- and water-tight seal. Optionally, as described further herein, this same cap can also serve as a lid for chute 106, capable of forming a similarly air- and water-tight seal at inlet 110. Alternatively or additionally, such a drainage portion or one or more drip trays can be separately removable from base 102 (and can be individually removed, in the case of more than one drip tray), for draining, cleaning, or in some aspects, juices can be maintained in sanitary storage for later use (e.g., use of olive brine or juice in dirty martinis, other juices used in other drinks, etc.), and in such a case, drain holes, perforations, etc. can be included in a surface of base 102 facing the undersides of the one or more chutes 106. Optionally, juice can be separated from fruit in other means, such as those described further herein. It is to be understood that juice from some chutes 106 can be drained (e.g., those containing citrus, etc.), while juice from others (e.g., olives, maraschino cherries, etc.) need not be, as described herein. In other aspects, the base can contain a drawer capable of sliding outward, which can be used for storage of other items, such as dry items (condiments, etc.) or other items, or can alternately be used for storage of cooling materials (e.g., ice, ice packs, etc.), in a manner similar to ice chest 104, as described herein.

In aspects, base 102 can have one or more base attachments that can be placed on the underside of base 102, and can be used as storage containers, etc. In one example, a base attachment could be a portion that has a top that can interconnect with or interlock with the bottom of base 102, and a bottom similar to base 102, such that any number of copies of that base attachment could be used simultaneously. These or other base attachments could be used for storage or other purposes, for example by having a tray or drawer that can be slid outward or removed, and in which items can be stored. Alternatively or additionally, in an embodiment requiring a power source (e.g., for refrigeration, etc.), a base attachment can comprise a battery, and can be connectable to the base 102 so as to supply power (e.g., to ice chest 104, etc.), and can optionally be connectable with other base attachments as described herein. Trays or drawers in base attachments (or other trays and drawers described herein, including candy drawers, etc.) can optionally include one or more dividers or inserts that can be used to separate the tray or drawer into a plurality of sub-compartments. In aspects, these dividers or inserts can be adjusted or removable and replaceable so as to provide sub-compartments of customizable sizes. Optionally, a vertically opening drawer or tray can be included along an edge of base 102 (e.g., the edge opposite slot or platform 108) or edges of chutes 106 (e.g., the shortened "front" end nearest the numerals 106, etc.), and can be attached via hooks or other means described herein, and can be used for storing additional items (e.g., extra items, items not used much, sword picks, cucumbers, olives, cherries, onions, etc.).

Further, although FIG. 1 depicts an example base capable of holding a single ice chest and one or more chutes on one side of the ice chest (as could be used in a variety of settings, such as a bar, etc.), other embodiments are also within the scope of the innovation disclosed herein, which is not intended to be limited by the specific examples and images discussed and shown. For example, embodiments with chutes on multiple sides of an ice chest, or with multiple ice chests are possible (and can be used in settings such as buffets, etc., where access may be needed from multiple sides), including embodiments with a central ice chest and chutes on all sides of it (or, for example, a circular or cylindrical ice chest, surrounded by chutes). It is to be appreciated that some portions of dispenser 100 may vary without necessitating variation of others (for example, chutes used in an embodiment such as the example embodiment shown in FIG. 1 could be used in double- or multi-sided embodiments or circular embodiments).

Ice chest 104 can be included in dispenser 100 as a removable portion that can cool fruit or other items contained in chutes 106. Although referred to as an ice chest, it is to be appreciated that substantially any means can be used for cooling, including but not limited to ice, cold liquids (e.g., water, etc.), "ice packs" (including chemical "ice packs," etc.), dry ice, etc. Additionally, in some embodiments, a powered cooling device may be used (e.g., electrical, condenser, etc.) to maintain a temperature in a desired or optimal range (which may depend on materials stored in the chutes, and can be selectable in some embodiments). In some aspects, ice chest 104 can be emptied from at or near the bottom of ice chest 104, such as via a drain, nipple, tap, etc. In other aspects, ice chest 104 can be emptied from the top, or can have a windowed portion of the bottom capable of sliding open. Optionally, a lid (not shown in FIG. 1) can be included, and can securely fit over the top of ice chest 104 (e.g., fastened in any of a number of ways, such as latches, clips, with an interlocking seal similar to that of airtight plastic storage containers like Tupperware® brand containers, etc.), so as to maintain a seal that can be insulating and reduce spills, etc. that otherwise could occur when removing or installing ice chest 104. In aspects, at least an edge of the lid can be permanently attached to ice chest 104, so as to flip open, etc. Optionally, a recessed insert (e.g., a tray, candy drawer, etc.) can be placed in the top of ice chest 104 and can be used for additional storage of items (such as items requiring a colder temperature, dry items, etc.), and such items can be stored in a sanitary manner with the lid of ice chest 104 in a closed position when access to the items is not needed.

In some aspects, ice chest 104 can have a bottom adapted for connection to an ice chest slot or platform 108 (e.g., for a slot, it can have a tapered or narrowed bottom and can be wider above the narrowed bottom, so as to rest securely in base 102 via an ice chest slot 108; for a platform, it can have a recessed bottom such that leading edges of the bottom of ice chest 104 can surround an ice chest platform 108; etc.), while optionally presenting a flush appearance of the combination of base 102 and ice chest 104 on the side opposite chutes 106 (e.g., in embodiments wherein ice chest 104 is an outward facing surface), which side can, in some aspects, be used for a variety of purposes, such as aesthetic or advertising purposes. In aspects, a display (e.g., a fixed or changeable advertisement, product identification, a screen such as a television, etc.) can be provided on this side, and, if necessary, dispenser 100 can be powered through any of a variety of means (e.g., an internal power source (rechargeable, replaceable, etc.) or an external power source (e.g., via outlet, etc.)). Additionally, the optional tapering or narrowing can be used to bring ice chest 104 closer to, or in contact with, the one or more chutes 106 when dispenser 100 is assembled.

Additionally, while ice chest 104 is depicted in FIG. 1 as being capable of inserted into base 102 vertically, in other embodiments than depicted in FIG. 1, ice chest 104 can be inserted in some other manner (e.g., horizontally, at an angle, etc.). Optionally, at least a portion of ice chest 104 (e.g., at or near the bottom, on a side facing chutes 106, etc.) can be contoured to match one or more portions of chute 106 when assembled in dispenser 100, so as to provide an alternative means of facilitating proper placement of ice chest 104 and chutes 106, as well as efficient cooling of chutes 106. Moreover, ice chest 104 can be insulated to maintain its lowered temperature for a longer period of time, and can optionally be less insulated or thermally conductive (e.g., by selection of materials, such as metals or other conductors, etc.) on one or more sides facing chutes 106, to better maintain a thermal equilibrium between ice chest 104 and chutes 106. In some embodiments, base 102 can include thermally conductive materials in proximity to either or both of ice chest 104 and the one or more chutes 106, to facilitate cooling of the one or more chutes 106. For example, the side(s) of ice chest slot 108 between the ice chest 104 and the one or more chutes 106 can be thermally conductive, or can be lowered or removed to provide direct contact between ice chest 104 and the one or more chutes 106. Alternatively or additionally, at least some portions of base 102 that will be in contact with the one or more chutes 106 can be made conduct to facilitate cooling of the chutes 106. As another example, if dividers are included to separate the one or more chutes 106, the dividers can be thermally conductive (and can optionally abut or in some other way be in close proximity to ice chest 104 (e.g., interlocking with, adjacent, etc.)). Also, as described further herein, the one or more chutes can include conductive portions to facilitate cooling of items stored therein. In some aspects, at least one of base 102, ice chest 104, or the one or more chutes 106 can have conductive surfaces or portions that face one another, while insulating portions that face outward, such that dispenser 100, when assembled, can maintain the items in the one or more chutes 106 at a lowered temperature while minimizing heat exchange with its environment.

The one or more chutes 106 can be placed in the base 102 adjacent to one another and to ice chest 104 when dispenser 100 is assembled. Chutes 106 can be modular and interchangeable with one another, and can comprise an open interior capable of storing a plurality of items. New fruit or other items can be placed into a top or inlet 110 of the chute 106, pushing older fruit or items through the open interior and closer to an exit (e.g., at door 112, etc.), facilitating a "first-in, first-out" (FIFO) selection of fruit or items placed in the chute 106 by dispensing items in a FIFO manner. This FIFO selection of items can ensure minimal loss of fruit or items through spoilage, etc., especially as compared with prior art systems and methods, which typically stack new fruit or items on top of old, leading to a "last-in, first-out" selection, that can cause older fruit or items to remain unused on the bottom, leading to spoilage. It is to be understood that in various aspects, the one or more chutes 106 can be interchangeable and can be substantially the same, or different embodiments of the one or more chutes 106 discussed herein can be used interchangeably in the same dispenser 100. Additionally, although certain features are discussed in connection with the example chute 106 illustrated in FIG. 1, it is to be understood that any of a variety of alternate embodiments which may differ in significant ways from that depicted are to be encompassed within the scope of the disclosure.

In an embodiment such as that depicted in FIG. 1, a chute 106 can have an inlet 110, through which fruit or other items can be placed in chute 106. In aspects, any of a number of varieties of lids can be used to secure the inlet 110 of a chute 106, such as those described in connection with ice chest 104, such as a removable lid, hinged lid, etc., so as to be able to form a sanitary and/or hermetic seal on the chute 106 so as to maintain items contained therein in a sanitary manner when access is not needed. Alternatively or additionally, a single lid can be placed over a plurality of chutes 106. In one example, individual removable lids can be used with individual chutes for secure and sanitary storage of chutes (e.g., in a refrigerator, etc.), and those individual lids can be used with the dispenser 100, or a single lid can be placed over multiple chutes when used in the dispenser 100 (e.g., a removable lid, or a hinged lid, such as one attached to base 102 or ice chest 104, etc.), which could facilitate restocking of multiple chutes contemporaneously. Moreover, as with ice tray 104, a candy drawer, tray, or recessed insert 112 can be placed in the inlet 110 of chute 106 and can be used for additional storage of items, such as dry items, etc. Such a candy drawer, etc. 112 can sit in the inlet 110 of a chute 106 and be removable for refilling of chute 106, and can be held up by hooks, clips, etc. or by alignment with corresponding portions of inlet 110 (e.g., in aspects, inlet 110 can have an inner ledge or portion of the interior of chute 106 such that candy drawer, etc. 112 can sit on the ledge, can have a top portion slightly wider than the inlet 110 so as to sit on the top edge of inlet 110, etc.).

In aspects of the innovation, a curved surface can be included on the interior of a chute 106, for example, as indicated by the curved dashed line in FIG. 1, that can facilitate a FIFO selection of items placed in a chute 106, and avoid the possibility of older items (e.g., fruit, etc.) remaining in a corner, while items inserted after them are used before them. In aspects, at least a portion of the chute that will be in contact with items stored therein can comprise metal or another conductor (e.g., part or all of the curved surface in embodiments including it, portions of one or more sides of the chute, etc.). A variety of designs can be used to facilitate FIFO selection of items, such as those described herein, and those variations that would be understood by a person of skill in the art in light of the teachings and specific examples herein. For example, although the example depiction of chute 106 in FIG. 1 includes a flat bottom for simplicity of illustration, it is to be appreciated that this is not a necessary feature. For example, at least a portion of one or more of the front or back of the bottom of chute 106 can be curved to facilitate FIFO selection of items, at least a portion of the bottom of chute 106 can remain flat (e.g., to allow chute 106 to stand upright when separate from base 102, such as when separately stored in a refrigerator, or to make replacement of a first chute with a second chute easier, etc.), or both. If portions of the bottom of a chute 106 are rounded, it is to be appreciated that base 102 and ice chest 104 can be modified to allow such a chute 106 to stand securely upright while being cooled, including by locating under that rounded bottom a cooling material (e.g., ice or other materials such as can be in ice chest) or a conductive material in contact or proximity to such a cooling material.

Optionally, chute 106 can include an internal drip tray or false bottom, so as to elevate fruit or other items such that they do not sit in juice, thereby increasing their useable lifespan. Holes, gratings, perforations or the like can be included in a chute 106 (e.g., as one or more of part of a curved inner surface, part of a lower inner surface on which fruit or other items sit, etc.) to allow drainage of juice, brine, etc., and in various embodiments can be stored internally, stored in a removable drip tray or false bottom in the chute 106 (e.g., one that clips on to the bottom of chute 106, one that slides out, etc.), allowed to pass through the bottom of chute 106 into base 102 (in aspects, such embodiments can include removable bottoms or the like that can be used for storage and detached when the chute 106 is placed in base 102), etc. In some embodiments, a mechanism such as a lever, switch, dial, etc. can be included for opening and closing an internal drip tray or false bottom, such as by inclusion (or removal) of a securely fitting cap, or by moving (e.g., rotationally, translationally, etc.) an adjustable drainage piece, thus aligning holes (or other features) or sealed portions of the adjustable drainage piece with holes (or other features) or sealed portions of a fixed part of chute 106, thereby allowing selection of open or closed settings.

Chute 106 can also include a door 114, that can be opened to allow access to fruit or other items contained within chute 106. Door 114 can be one or more of removable, hinged (e.g., at or near line A-A on FIG. 1, etc.), flexible and capable of sliding upward (e.g., similar to a garage door, etc.), etc. Optionally, door 114 can be maintained in an open position by one or more of gravity (e.g., by having a hinge below line A-A, and opening door 114 past vertical, to lean on the surface 116 above line A-A, etc.), magnets, Velcro®, clips, hooks, friction (e.g., at a hinge, in a track associated with a "garage door" type of door, etc.), or by other means. In some aspects, a single removable door can cover a plurality of chutes to allow simultaneous access to the plurality, while individual removable doors can be used for storage of chutes. In some embodiments, the proportions of door 114 and the surface 116 above line A-A can be such that no portion of door 114 protrudes past inlet 110 when in an up position. Additionally, at least one of door 112 and other portions of chute 106 (e.g., the surface 116 above line A-A, etc.) can be transparent or translucent so as to indicate how much fruit, etc. is contained therein, and thus whether refilling will soon be necessary.

Chute 106 can be readily inserted or removed by placement in the base 102 and optional alignment via any of a variety of means discussed herein (e.g., dividers, raised portions, complementary portions of base 102 and chute 106, etc.), and in some embodiments can be tilted into or out of position for installation or removal. Optionally, however, in some embodiments, chute 106 can include handles, contours, or other means to hold chute 106 for removal, insertion, or transportation. For example, handholds (either recessed or protruding) or other portions able to be gripped can be included on one or more surfaces of chute 106. In one example, a handhold can be included on the surface 116 above line A-A, which can be used for installation, removal or transportation of the chute 106, while also serving as a means for maintaining door 114 in an open position (such as via a tab or clip of the door latching onto the handhold, or by any other means discussed herein). Additionally, in some embodiments, the size of an opening through which fruit can be accessed can be adjustable (e.g., through position of some versions of door 114, or via an optional moveable panel at the surface 116 above line A-A, etc.). In another example, lid 110 can be sufficiently secured to chute 106 (e.g., via latches, other means discussed herein, etc.) when lid 110 is in a closed position that an optional handle on lid 110 can be used for insertion, removal, or transportation of chute 106.

In some embodiments, dispenser 100 can further include a sleeve or back 118 that can be attached to or placed adjacent to base 102 on the outside of ice chest 104. Optionally, sleeve or back 118 can have a display or screen such as that discussed in connection with ice chest 104. In various aspects, sleeve or back 118 can be a separate piece from or can be connected to base 102. Additionally, sleeve or back 118, whether a separate piece or not, can be adapted to mount one or more side storage containers 120 that can be attached via snaps, locking mechanisms, clips, hooks, etc. Side storage containers 120 can have individual compartments such as at $\mathbf{120}_1$, or can have multiple components as at $\mathbf{120}_2$, and multiple-compartment versions can have compartments at the same or different levels. In aspects, compartments at multiple levels can be arranged so that the levels increase in height in a single direction, to facilitate observation and selection of items therein. Optionally, lids can be included. Various items can be stored in the side storage containers 120, such as beverage napkins, straws, swords, coasters, umbrellas, sipping or stirring sticks, pens, wine keys, bottle openers, flashlights, lighters, etc. Although substantially any item can be stored in various components capable of storage as described herein, some are more advantageously stored in some components, while others are more advantageously stored in others (e.g., the side storage containers 120 can provide ready access to items stored therein, but are less effectively cooled by ice chest 104 than the chutes 106, which also facilitate FIFO selection, while side storage containers 120 do not, etc.).

Optionally, a top 122 can also be included in dispenser 100. Top 122 can optionally serve one or more functions, such as to provide a single lid to cover the chutes 106 (and ice chest 104, if open-topped), to provide additional insulation to ensure fruit or other items in dispenser 100 remain cold longer, etc. In aspects, top 122 can securely fit over the chutes 106 so as to provide an air- or liquid-tight seal, and can contain one or more portions on the underside of top 122 that can interlock with inlets 110 in order to ensure an adequate seal. Also, in some embodiments, top 122 can be a separate component, or can be attached to (e.g., and hinged, etc.) sleeve or back 118, both in embodiments wherein sleeve or back 118 is a separate component from base 102, and wherein they are a single component.

In some embodiments, dispenser 100 can include a thermometer or other means for determining a temperature (for example, of the material in ice chest 104, or in one or more of the chutes 106). For example, thermometers or other temperature sensitive materials or devices can be included to determine such a temperature or temperatures. Although specific temperature information can be provided (for example, via a thermometer, in ° C., ° F., etc.), other temperature indicators can be used, such as a color-changing display that indicates any of a plurality of states (e.g., sufficiently cold, insufficiently cold, borderline, etc.) that can be selected, for example, for health or other reasons, a display that indicates via some signal (e.g., visual, auditory, etc.) when action (such as adding more coolant, etc.) needs to be taken, etc.

Figure 2:
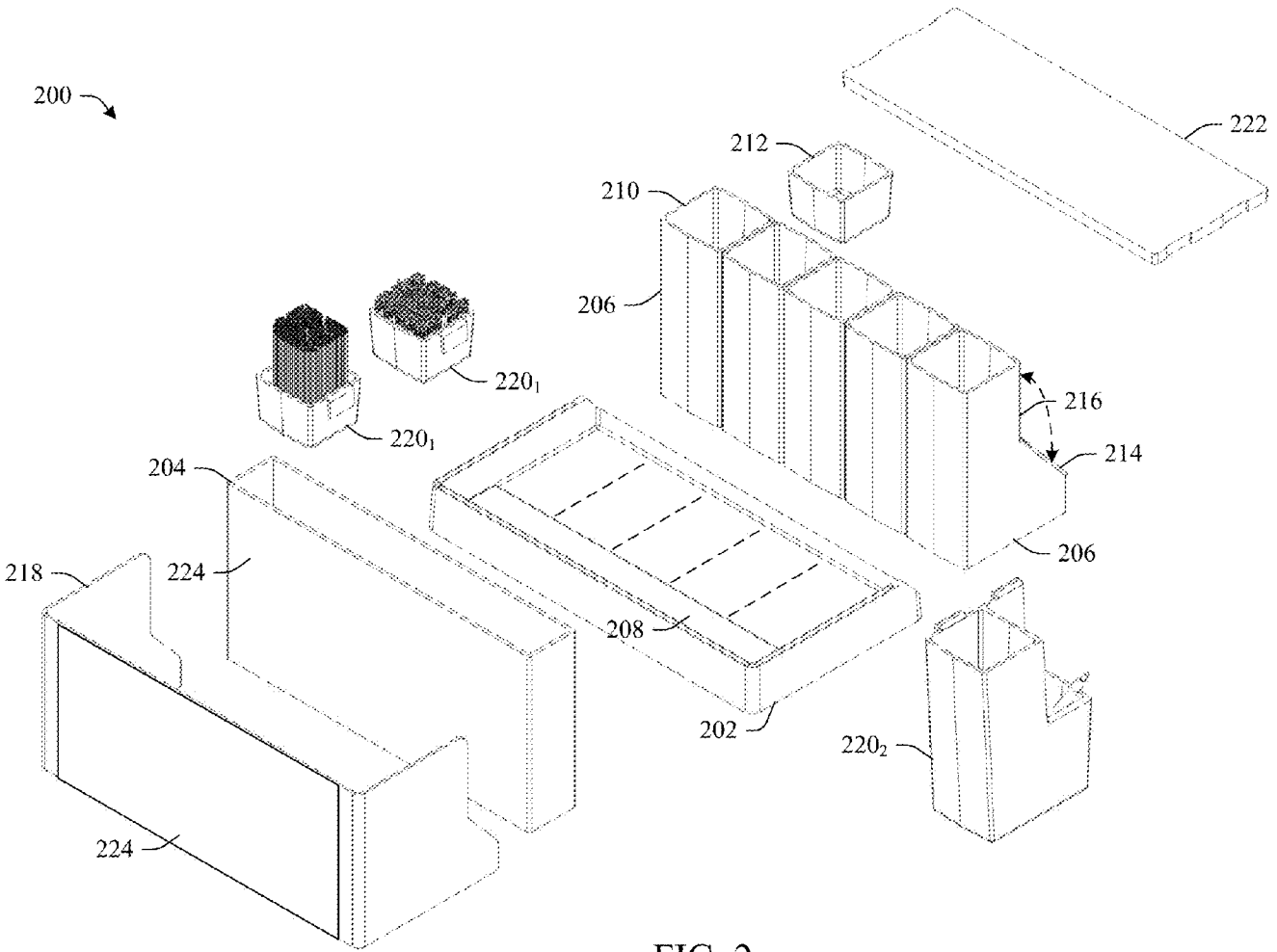
FIG. 2 illustrates an alternative view of an embodiment of a dispenser such as that shown in FIG. 1.

FIG. 2 illustrates an alternative view of an embodiment of a dispenser 200 such as that shown in FIG. 1. Like reference numbers of dispenser 200 correspond to like portions of dispenser 100. Dispenser 200 additionally shows an optional display or screen 224 that can be placed on at least one of an outer face of a ice chest 204 (or 104) or sleeve or back 218 (or 118).

Figure 3:
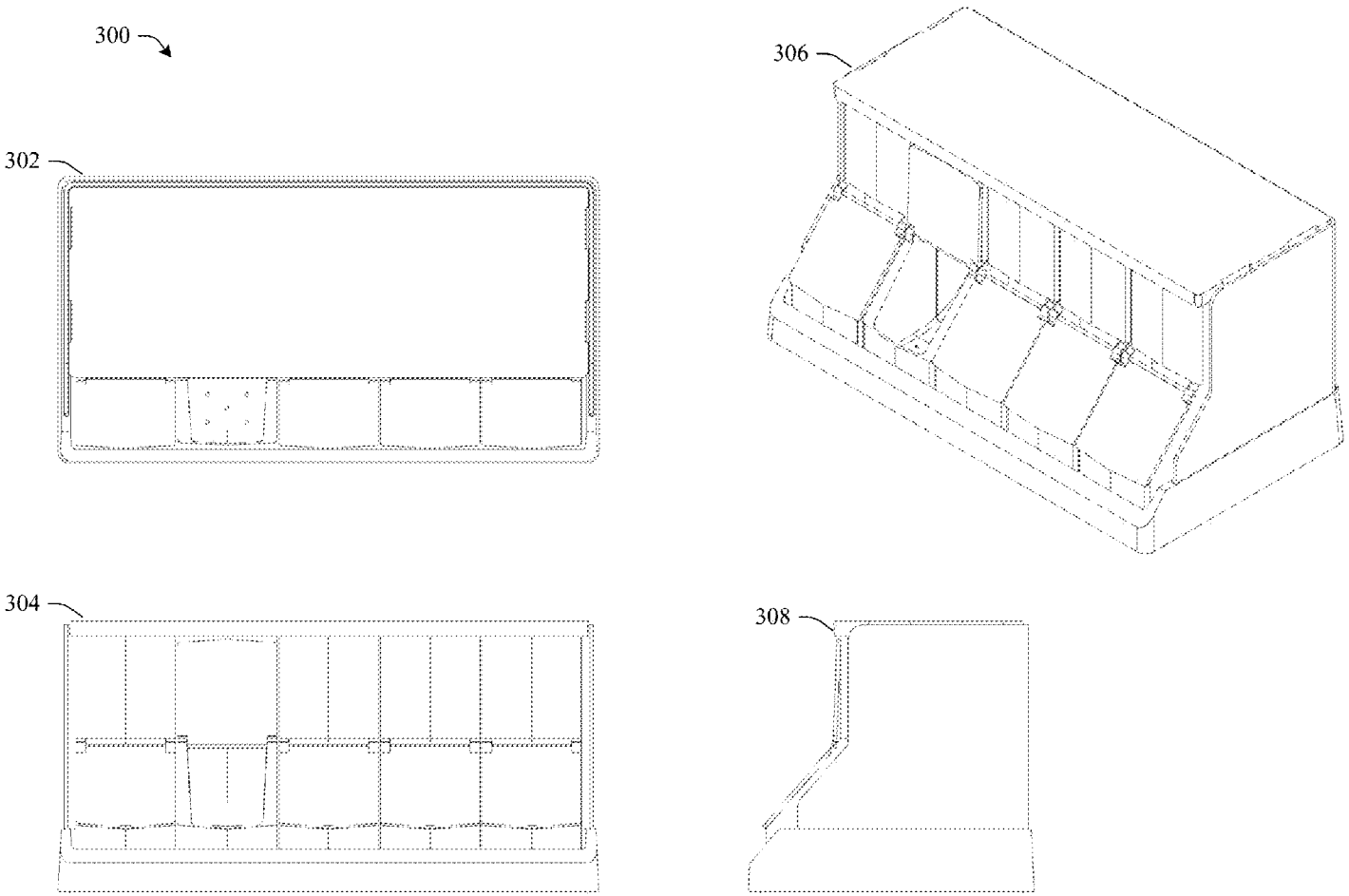
FIG. 3 shows multiple views of an example assembled dispenser.
Figure 4:
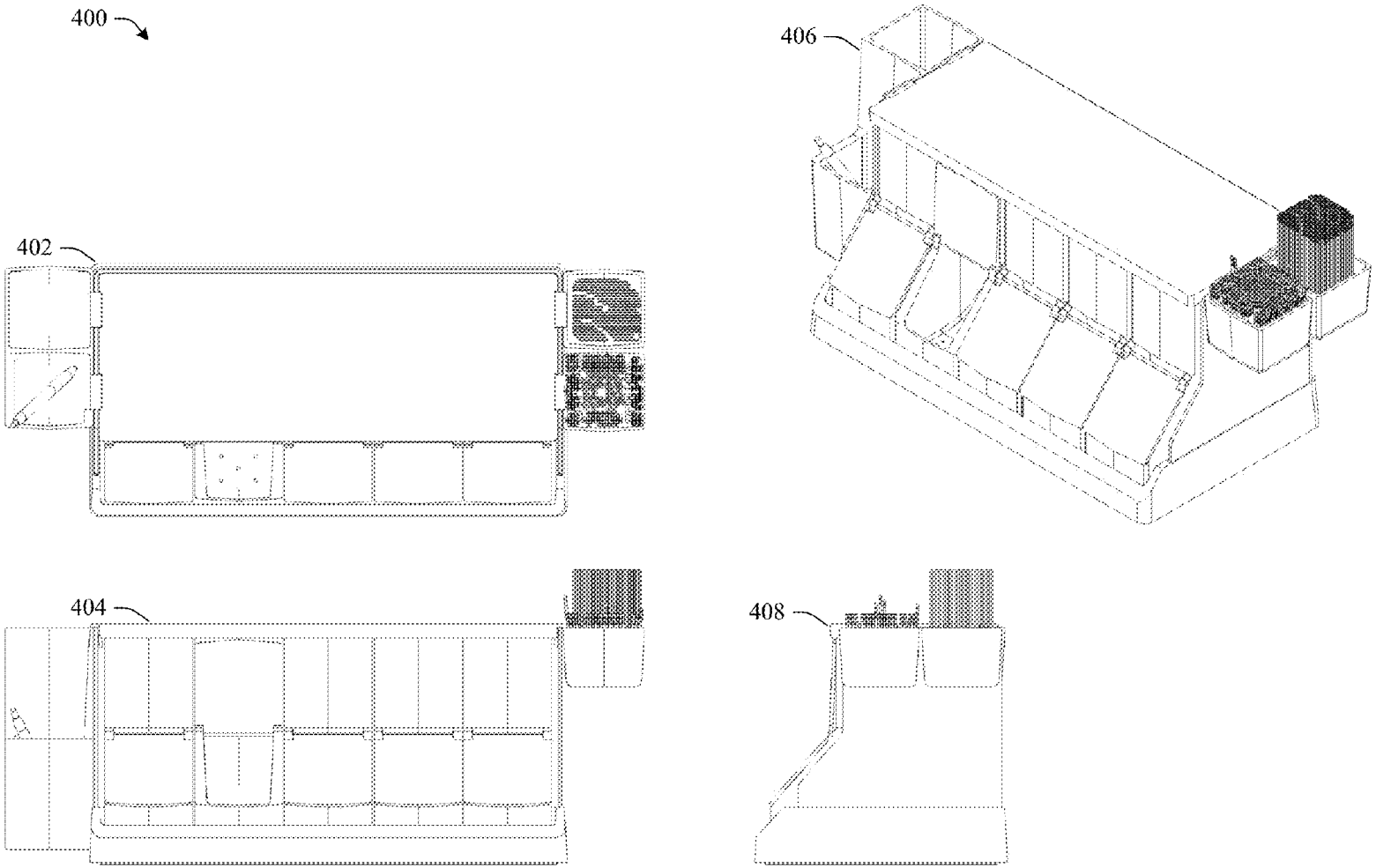
FIG. 4 shows multiple views of another example dispenser.
Figure 5:
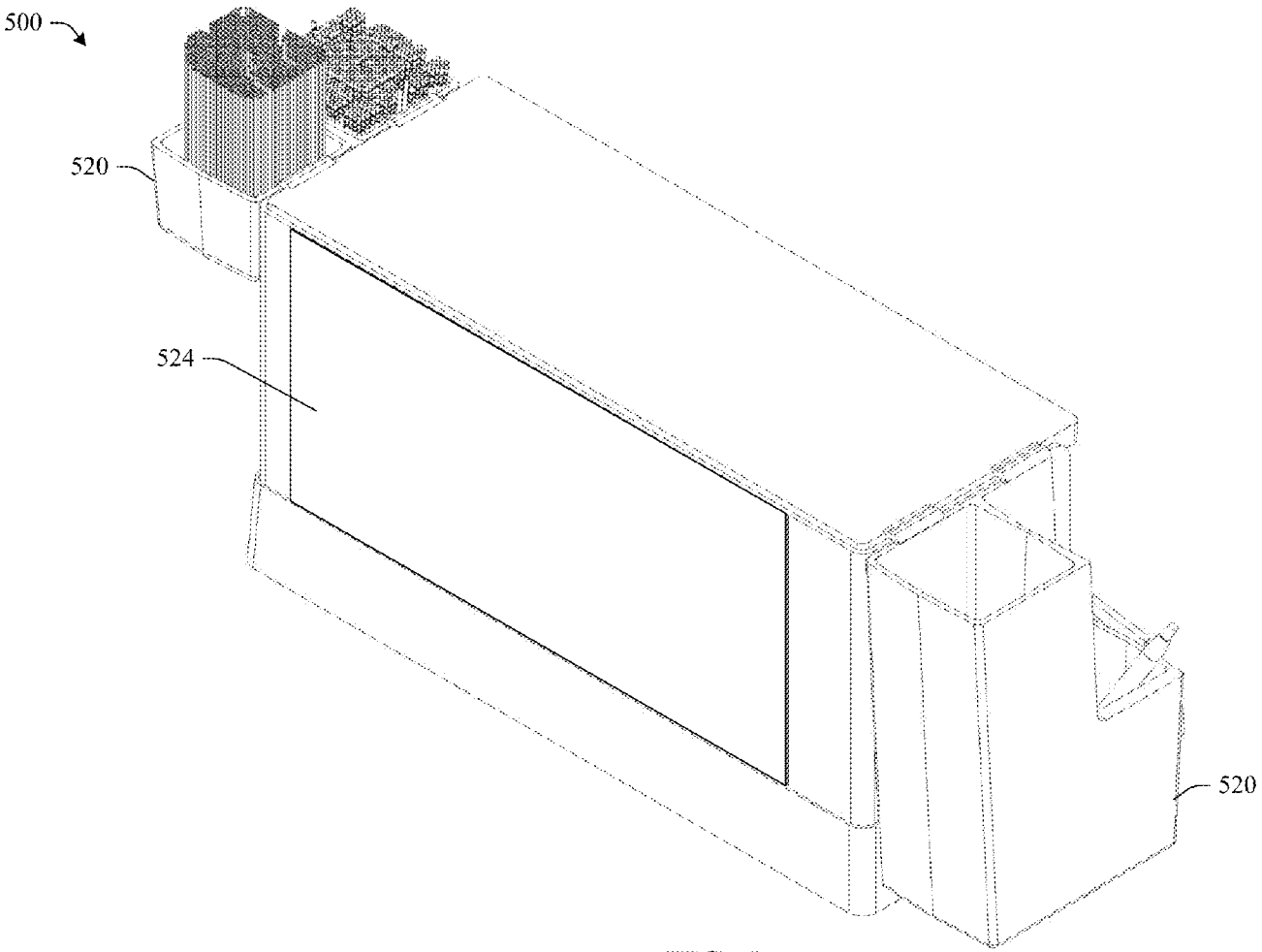
FIG. 5 shows a perspective view of an assembled dispenser in accordance with aspects of the innovation.

FIG. 3 shows multiple views of an example assembled dispenser 300 similar to aspects described in connection with dispenser 100 (with one door such as door 114 open), from a top view 302, front view 304, perspective view 306, and side view 308. Dispenser 300 includes some components (e.g., base, chutes with doors, top, back or sleeve), while not including others. FIG. 4 shows multiple views of another example dispenser 400, similar to other aspects described in connection with dispenser 100 (with one door such as door 114 open), from a top view 402, front view 404, perspective view 406, and side view 408. As can be seen from comparison between FIGS. 3 and 4, the optional nature of multiple components (e.g., side storage containers in FIG. 4 but not in FIG. 3) provides customizability in various embodiments of the subject innovation. FIG. 5 shows a perspective view of an assembled dispenser 500 in accordance with aspects of the innovation. Example dispenser 500 comprises multiple side storage containers 520 and a screen or display 524.

Figure 6:
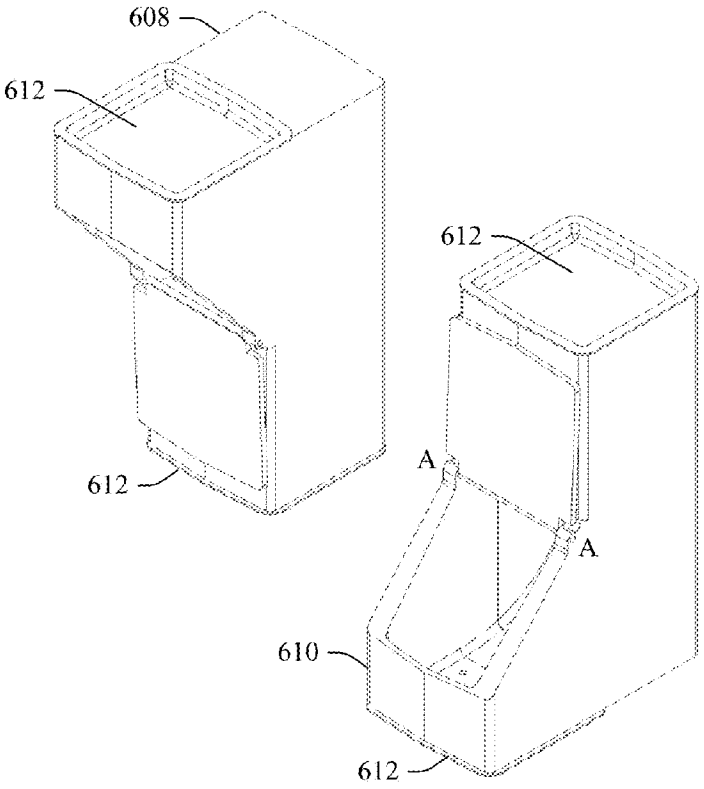
FIG. 6 shows multiple views of one embodiment of a chute in accordance with aspects of the innovation.
Figure 6:
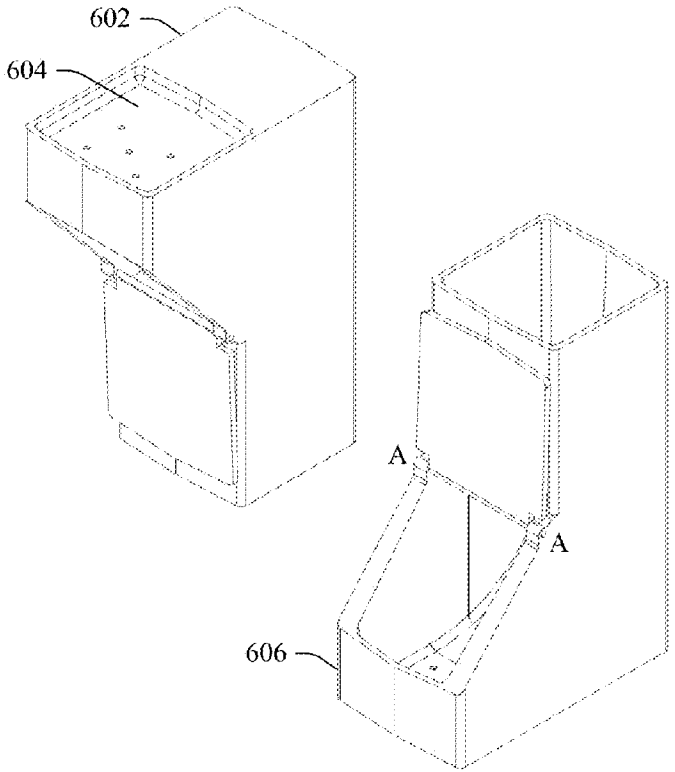

FIG. 6 shows multiple views of one embodiment of a chute in accordance with aspects of the innovation. Shown is a bottom perspective view 602 of an example chute with an exposed false bottom 604, and a top perspective view 606 of the same. Additionally shown is a bottom perspective 608 and a top perspective 610 of an embodiment without an exposed false bottom. In some aspects, as discussed herein, the chutes of views 602 and 606 on the one hand can be substantially the same as the chutes of views 608 and 610, with the inclusion of one or more caps 612 in the latter. In some embodiments, cap 612 can be removable and adapted to securely fit both on an inlet such as inlet 110 and on a false bottom or drip tray such as false bottom 604. A chute such as the embodiments shown in FIG. 6 can be securely stored (e.g., in a refrigerator, etc.) by attaching one or more caps 612 to cover an inlet and false bottom 604, and by closing the door.

Figure 7:
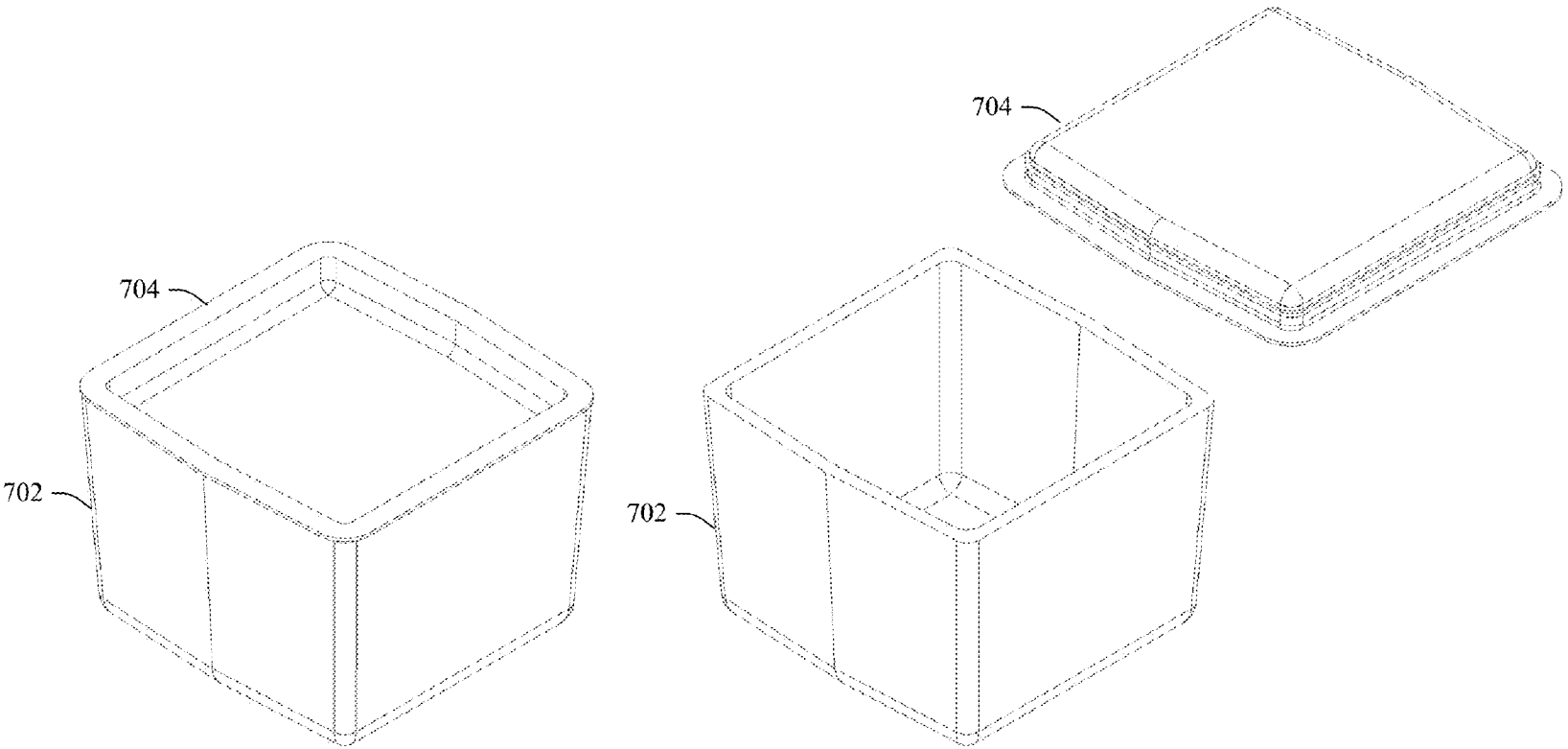
FIG. 7 shows two views of a candy drawer that can be placed in an inlet of a chute, along with a cap capable of interconnecting with a candy drawer.

Turning to FIG. 7, illustrated is two views of a candy drawer 702 that can be placed in an inlet of a chute, along with a cap 704 capable of interconnecting with candy drawer 702, and useable as a lid for candy drawer 702. In aspects, cap 704 can be useable with chutes of aspects of the subject innovation, such that, optionally, a given cap 704 can serve as a lid for a chute, for a candy drawer 702, for a side storage container, or to cover a false bottom of a chute (and, for example, in embodiments of chutes with a removable door, the opening for the door can be such that cap 704 can also provide a secure cover for that opening). Although shown as a removable lid in FIG. 7, in other embodiments, candy drawer 702 can have an attached or attachable lid (e.g., hinged, etc.).

Figure 8:
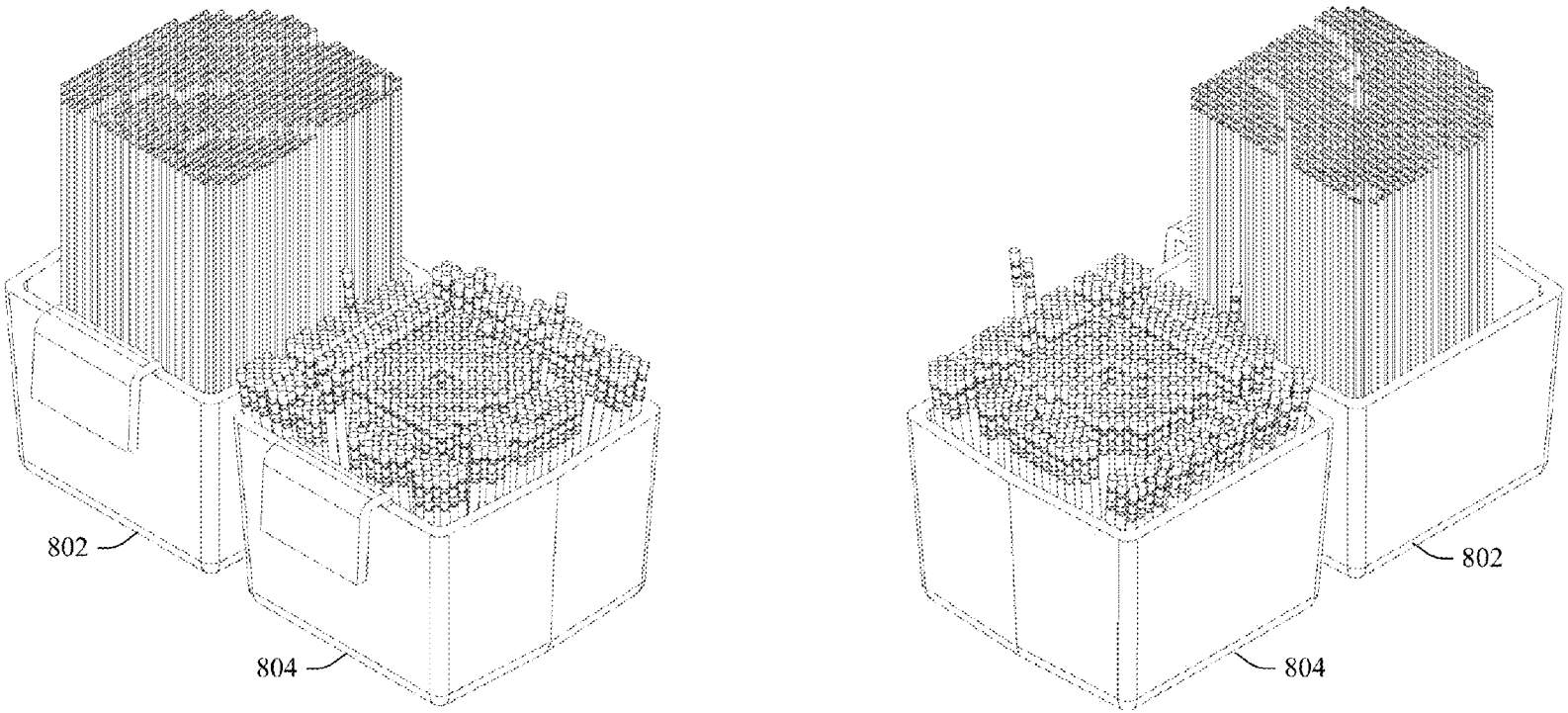
FIG. 8 shows multiple perspectives of side storage containers useable in aspects of the subject innovation.
Figure 9:
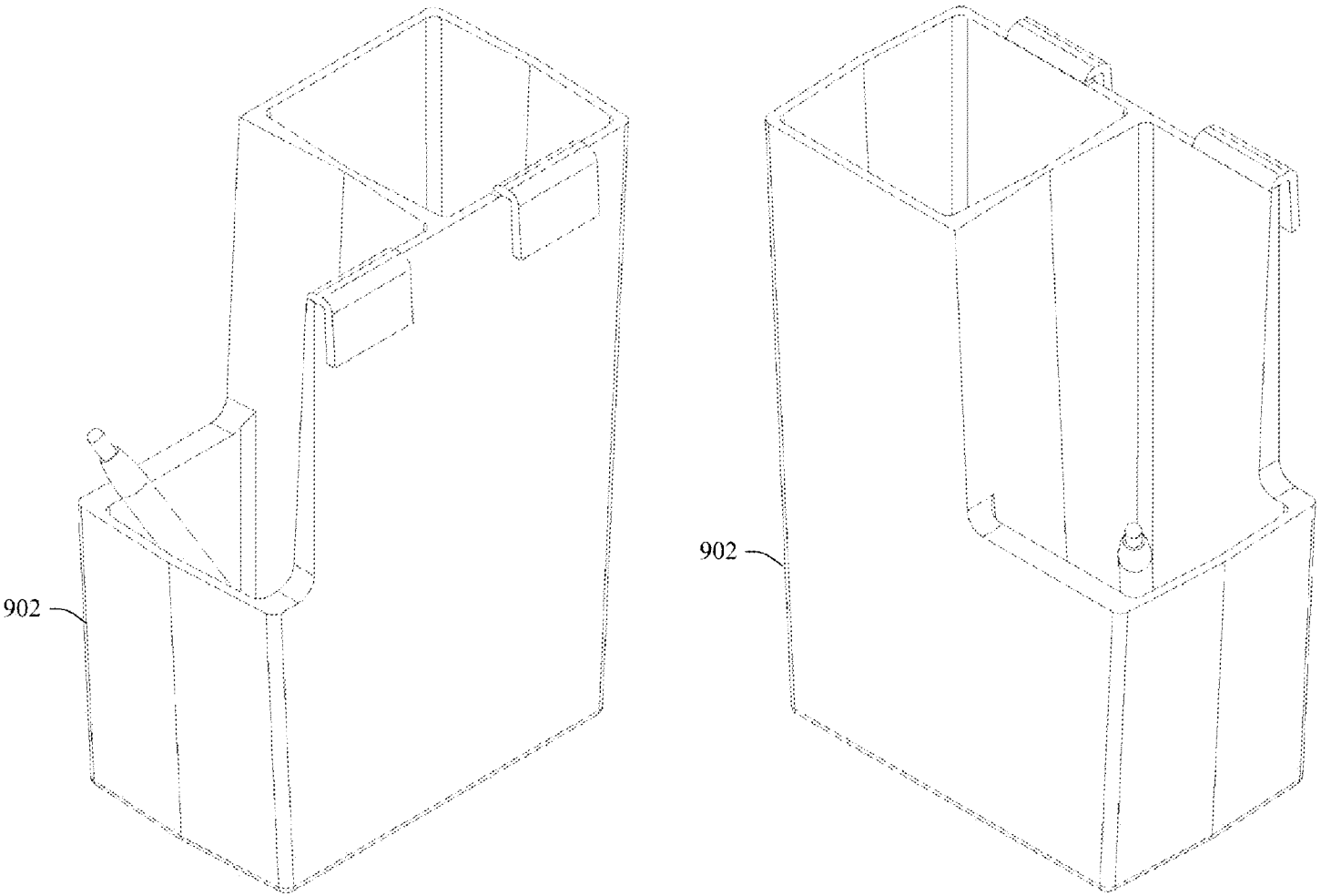
FIG. 9 shows two perspectives of a multiple-compartment side storage container useable in aspects of the subject innovation.

FIGS. 8 and 9 show multiple perspectives of different side storage containers useable in aspects of the subject innovation. The side storage containers 802 and 804 shown in FIG. 8 are single compartment containers, while that of FIG. 9 is a multiple-compartment side storage container 902. Although these containers are shown without lids, attached or removable lids can be included, such as caps useable with other components (e.g., candy drawer, chute, etc.). Additionally, as shown in FIG. 9, different components of a multiple component side storage container can have different heights or be staggered, to facilitate access to or storage of different items. Further, as seen in FIGS. 8 and 9, side storage containers 802, 804 and 902 can be attachable to a base 102, sleeve or back 118, or other components of a dispenser such as dispenser 100 via hooks, clips, or other attachment means discussed herein.

Figure 10:
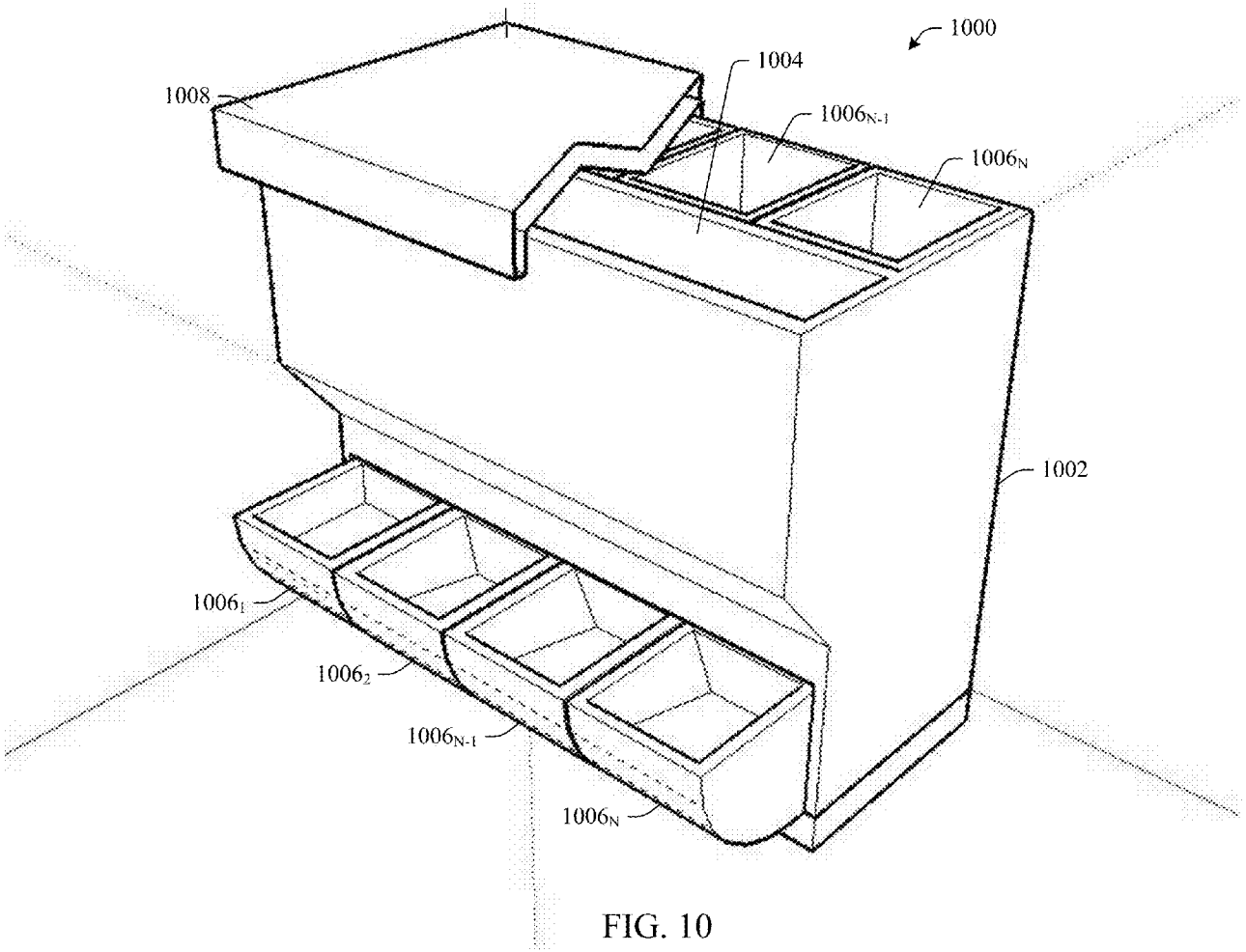
FIG. 10 illustrates a right front perspective view of an alternative example embodiment of the innovation.

Referring now to FIG. 10, an alternative example dispenser 1000 is shown. As shown, the example dispenser 1000 can comprise a base 1002 that can house an ice chest 1004, similar to ice chest 104, although at an elevated position and adjacent to a dispensing face of one or more separate chutes $\mathbf{1006}_1$ to $\mathbf{1006}_N$. As described above, the chutes 1006 can be interchangeable as desired, for example as appropriate in accordance with a fruit type, etc.

As the top 1008 of base 1002 is shown in a cut-away view, it can be seen that chutes 1006 can be exposed when the roof or top is removed or otherwise moved (e.g., hinged open), although separate lids, candy trays, or other inserts can optionally be used. In aspects, either dispenser 1000 or any other dispensers discussed herein can be securely held together as one unit via various interconnections, and transported via one or more handles on a base (e.g., 102 or 1002, etc.), top 1008, or other similar features.

Figure 11:
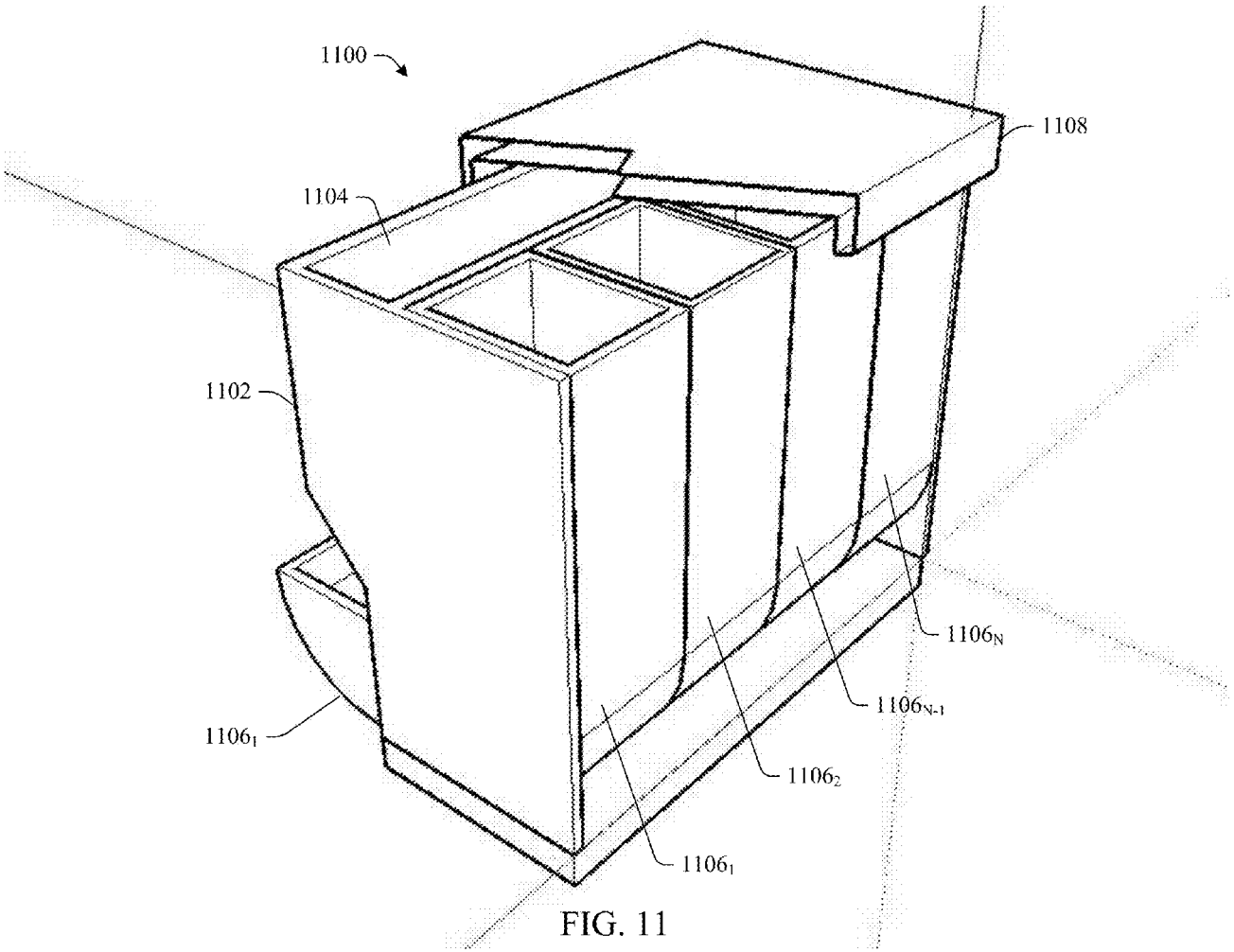
FIG. 11 illustrates an alternative view of the example embodiment of FIG. 10.

FIG. 11 is an alternative view of the example dispenser of FIG. 10. As shown in FIG. 11, each of the chutes 1006 can be easily removed (or loaded), e.g., from the back side of the housing. In aspects, an optional door or insert (e.g., removable, or able to open out, up, down, etc. via hinges or other similar means) can be placed on the back side to cover the exposed faces of chutes 1006 and secure them in position when not being removed, inserted, cleaned, etc. Optionally, this door or insert can include a screen or display similarly to back or sleeve 118. As with the removable chutes of FIG. 1, these chutes can be readily and separately removed, replaced, cleaned, etc. Additionally, each chute can be separately sealable and can be placed into a refrigerator for keeping. Similarly, chutes of any embodiment can be pre-loaded with fruit or other items and refrigerated. These pre-loaded chutes can be installed or loaded into a base as desired.

Additionally, other variations can include bases or dispensers with other configurations, such as side-loadable chutes, etc. While specific dimensions and configurations have been shown, it is to be understood that the variations of dimensions, configurations and orientations are countless. Thus, the features, functions and benefits of the innovation as described herein are intended to include all such variations in dimensions, configurations, orientations, shapes, etc. without departing from the scope of this specification. Similarly, while fruit dispensing is described in the aspects, other foodstuff or items can be employed in alternative aspects—each of which is to be included within this disclosure.

Essentially, in aspects, the innovation discloses a dispenser that can be used by bars, restaurants, buffets, catered events, or at home to distribute, e.g., a garnish for cocktails or desserts. In view of the "first-in first-out" dispensing mechanism, the innovation will allow a bartender to use the oldest fruit first so that spoilage is limited. It will be appreciated that some fruits remain fresher if it is not sitting in its own juice. Conversely, some would be better served to sit in juice. Thus, the innovation can have "interchangeable" or modular sleeves where some drain and some do not.

The subject innovation can minimize loss of fruits and other items. For example, when fruit sits in citrus juice it is prone to rot at a much higher rate than if it does not. Therefore, by using the innovation, a restaurant owner will save substantial amounts of money by not having to throw away rotten fruit. Moreover, in addition and in accordance with the innovation, bartenders simply put the new fruit on top of the older fruit and thus the older fruit is pushed to the door or front of the dispenser to be used next, while in prior art systems and methods, the older fruit rots and is either used rotten or discarded.

In aspects, the innovation can be configured into an aesthetically pleasing look for any bar top, buffet, catered event, etc. Other aspects can be built into a refrigerator or other cooling appliance as desired. The dispenser may be partially or wholly made by molded plastic or other suitably rigid material, and may comprise one or more portions composed of metal or another conductive material to facilitate heat transfer within the dispenser to maintain fruit or other items at a sufficiently cold temperature. It can also have an interchangeable cold pack inserted that will keep the fruit chilled enhancing freshness and longevity.

In some embodiments, there can be several size chutes (or sleeves or slides) that hold the fruit for various different types, e.g., lemon wedges, lime wedges, orange wedges, cherries, olives, etc. While common fruits are used, other aspects can employ ancillary fruit choices, including but not limited to, pineapple, strawberries, other berries, etc., or other items of a non-fruit or even non-edible variety. It will be understood that the innovation can not only save bar and restaurant owners thousands of dollars in spoiled fruit, it can also protect unused fruit from germs and bacteria.

In view of the overall design features, this apparatus is easy to clean and maintain. The apparatus can have a lid that is removable or openable to add fruit. As described supra, the lid can also, in aspects, be a secure handle for easy use. Additionally, the lid can provide a secure way for the fruit to be protected from bacteria germs, smoke and customer's human touch, such as the "self-service" customer putting their fingers in the fruit. Further, if necessary or appropriate, the lid can be equipped with vents or holes that provide for air circulation.

Overall, the chutes or sleeves can be interchangeable for loading and/or cleaning. The slider concept of the innovation is "green" and clean—using less product, e.g., fruit. As a result, fruit can last for days if it is taken care of properly, and the chutes can serve as containers for refrigeration of fruit when not in use. This device can insure that the cut fruit from yesterday can be preserved via refrigeration, etc., until use, and can come out first and not be wasted.

It will be appreciated that the innovation can alleviate the responsibility of the bartender or barback to rotate fruit, which often does not occur on a regular basis. Newly cut fruit placed on top of saturated fruit submerged in its own citrus juice may spoil twice as fast as fruit that does not rest in its own juices. In addition to the aforementioned features, functions and benefits, yet other embodiments may include removable caps to place on top of the pull out or removable chutes, for example, if one wishes to store a sleeve separately from the unit, e.g., in a refrigeration or other remote cooling unit. In other scenarios, when chutes are used and need to be washed, but other foodstuff such as olives and cherries are full and need to be stored. These removable caps or lids can also be used for back up fruit on busy night where one can replace a full container whereby the sleeve will not spill or topple over in or near the dispenser, potentially dropping fruit and creating a mess.

Finally, compartments or trays can be fixedly (or removably) attached to the unit (e.g., on the sides). These compartments can be used for storage and easy access to straws, beverage napkins, wine keys, bottle openers, toothpicks, beverage swords or the like. Most any mechanism can be used to attach the compartments including but, not limited to, pressure guides, snap fits, magnets, adhesives or the like. It will be understood that the compartments can be interchangeable as appropriate. Additionally, if desired, the compartments can be molded into the unit as appropriate or desired.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A dispensing system, comprising:

a plurality of garnish items that each include an edible garnish solid portion and an edible garnish liquid portion;

a base having one or more cavities therein;

a plurality of removable garnish storage chutes configured to align within a subset of the one or more cavities of the base so that the base supports the plurality of removable garnish storage chutes once the chutes have been aligned and inserted into the subset of the one or more cavities of the base, each of the chutes comprises:

an inlet that provides access to an open interior that facilitates storage of the plurality of garnish items;

an access opening for removal of the plurality of garnish items; and a plurality of perforations on a bottom surface of each chute, wherein the plurality of perforations facilitates separation of the edible garnish liquid portion from the edible garnish solid portion; and wherein the inlet and access opening of the plurality of removable garnish storage chutes are arranged to provide dispensing of the plurality of edible solid portions in a "first-in first out" manner.

2. The system of claim 1, wherein at least one of the plurality of chutes comprises a curved inner surface that facilitates dispensing the plurality of edible garnish solid portions in the "first-in first out" manner.

3. The system of claim 1, wherein at least one of the plurality of chutes comprises a door capable of providing access to the plurality of edible garnish solid portions in the "first-in first out" manner.

4. The system of claim 1, wherein each of one or more of the chutes comprises a cap sized to be capable of covering the inlet and, alternatively, a false bottom of each of the one or more of the chutes.

5. The system of claim 1, wherein each of one or more of the chutes comprises one or more of a selectively operated drip tray that enables the edible liquid portion to escape the chute and alternatively tle edible liquid portion not to escape the chute.

6. The system of claim 1, further comprising a sleeve mountable on the base and at least one side storage container, wherein the at least one side storage is attachable to the sleeve.

7. The system of claim 1, wherein the base comprises at least one of raised portions or dividers, wherein the raised portions or dividers facilitate alignment of the plurality of chutes within the base.

8. The system of claim 1, wherein the base comprises one or more of a drawer or a tray capable of storing at least one of fluids or items.

9. The system of claim 1, wherein the ice chest comprises a powered cooling device.

10. The system of claim 1, wherein the ice chest comprises at least one of a drain, a nipple, or a tap that facilitates drainage of the ice chest.

11. The system of claim 1, further comprising a plurality of candy trays capable of being aligned within the inlets of the plurality of chutes, wherein the plurality of candy trays are capable of storing a second plurality of items.

12. The system of claim 1, wherein at least one of the plurality of chutes is constructed at least in part from metal to facilitate cooling of the plurality of items.

13. The system of claim 1, further comprising a thermometer that indicates a temperature associated with one or more of the ice chest or at least one of the plurality of chutes.

14. A method of dispensing items, comprising:

providing a plurality of garnish items, each of the plurality of garnish items having an edible liquid portion and an edible solid portion;

providing a base having one or more cavities therein;

providing a plurality of removable garnish storage chutes, each of the chutes comprises:

an inlet that provides access to an open interior that facilitates storage of the plurality of garnish items; and an access opening for removal of the plurality of garnish items; and perforations in a bottom surface of each chute;

inserting the plurality of removable garnish storage chutes, upon alignment within a subset of the one or more cavities of the base, so that the base supports the plurality of removable garnish storage chutes;

placing the plurality of garnish items into the plurality of chutes via the inlet of each chute, separating the edible liquid portion from the edible solid portion via the perforations;

storing each of the edible liquid portion and the edible solid portion in the plurality of chutes;

cooling the plurality of garnish items stored in the plurality of chutes via an ice chest; and dispensing the edible solid portion of each of the plurality of garnish items in a "first-in, first-out" manner.

15. The method of claim 14, further comprising determining a temperature of at least one of the ice chest or the plurality of chutes.

16. The method of claim 14, further comprising storing a second plurality of items in one or more candy trays, wherein the one or more candy trays are aligned with inlets of the plurality of chutes.

17. The method of claim 14, wherein cooling the plurality of garnish items comprises cooling the plurality of items via a powered cooling mechanism.

18. The method of claim 14, further comprising selectively separating the edible liquid portion from the edible solid portion into one or more integral false bottoms.

19. A system for dispensing items, comprising:

a fruit item having an edible liquid portion and an edible solid portion;

a base comprising a plurality of cavities;

a plurality of chutes aligned in a subset of the cavities, wherein each of the chutes comprises an inlet that provides access to an open interior capable of storage of the fruit item, a door that provides access to the edible solid portion of the fruit item, at least one drip tray for separation of the edible liquid portion from the edible solid portion, and a curved inner surface that facilitates access to the edible solid portion in a "first-in, first-out" manner, wherein the at least one drip tray includes a mechanism that facilitates selective opening and closing of the at least one drip tray to allow and block the edible liquid portion.

20. The system of claim 19, further comprising a thermometer that indicates a temperature associated with one or more of the ice chest or at least one of the plurality of chutes.

* * * * *